US007051556B2

(12) United States Patent
Oya et al.

(10) Patent No.: US 7,051,556 B2
(45) Date of Patent: May 30, 2006

(54) STRETCHABLE WARP-KNITTED FABRIC, METHOD FOR MANUFACTURING THE SAME, AND STRETCHABLE CLOTHING USING THE SAME

(75) Inventors: Kei Oya, Kyoto (JP); Masami Saito, Kyoto (JP); Mayumi Ogawa, Kyoto (JP); Ikuhiro Yamada, Shiki-gun (JP); Yasue Kawashima, Ashikaga (JP)

(73) Assignee: Wacoal Corp., Kyoto (JP)

( * ) Notice: Subject to any disclaimer, the term of this patent is extended or adjusted under 35 U.S.C. 154(b) by 0 days.

(21) Appl. No.: 10/490,522

(22) PCT Filed: Oct. 31, 2002

(86) PCT No.: PCT/JP02/11329

§ 371 (c)(1),
(2), (4) Date: Jul. 13, 2004

(87) PCT Pub. No.: WO03/040448

PCT Pub. Date: May 15, 2003

(65) Prior Publication Data

US 2004/0237597 A1 Dec. 2, 2004

(30) Foreign Application Priority Data

Nov. 5, 2001 (JP) ..... 2001-340071
Nov. 5, 2001 (JP) ..... 2001-340072
Jun. 25, 2002 (JP) ..... 2002-184580

(51) Int. Cl.
*D04B 9/42* (2006.01)

(52) U.S. Cl. ..... 66/172 E; 66/195

(58) Field of Classification Search ..... 66/195, 66/190–193, 172 E, 172 R; 442/306, 312
See application file for complete search history.

(56) References Cited

U.S. PATENT DOCUMENTS 4,244,199 A * 1/1981 Rhode ..... 66/193
5,029,457 A * 7/1991 Gajjar ..... 66/195
5,669,247 A * 9/1997 McCartney et al. ..... 66/195
6,401,497 B1 * 6/2002 Nishiyama et al. ..... 66/172 E

FOREIGN PATENT DOCUMENTS

EP 1 136 001 A1 9/2001

(Continued)

OTHER PUBLICATIONS

"Braiding Technology" by H. Yoneda, p. 297, Jan. 31, 1953.

*Primary Examiner*—Danny Worrell
(74) *Attorney, Agent, or Firm*—Darby & Darby

(57) ABSTRACT

The present invention provides stretchable warp-knitted fabric that is a 1×1 tricot formed by running a non-elastic yarn and an elastic yarn side by side in such a manner that in each stitch, at least one of the non-elastic yarn and the elastic yarn forms a closed loop, a method for manufacturing the fabric, and stretchable clothing using the fabric at least in a part. Since a cut edge of the knitted fabric can be used as a hem of the clothing without finishing, sewing is simplified. It is possible to provide fashionable clothing that has appropriate stretchability enabling the clothing to well fit the body of the wearer, that is thin and has a beautiful texture, and that, when it is formed in underwear, has a hem line invisible through outerwear.

18 Claims, 6 Drawing Sheets

(C)

FOREIGN PATENT DOCUMENTS

| | | | |
|---|---|---|---|
| JP | 11-81108 | A1 | 3/1999 |
| JP | 11-81109 | A | 3/1999 |
| JP | 2000-314063 | A | 11/2000 |
| JP | 2001-181908 | A | 7/2001 |
| JP | 2001-248047 | A | 9/2001 |
| JP | 2001-348762 | | 12/2001 |
| JP | 2001-355161 | | 12/2001 |
| JP | 2004-27465 | | 1/2004 |

* cited by examiner (A)

(B)

(C)

(D)

STRETCHABLE WARP-KNITTED FABRIC, METHOD FOR MANUFACTURING THE SAME, AND STRETCHABLE CLOTHING USING THE SAME

CROSS-REFERENCE TO PRIOR APPLICATION

This is a U.S. national phase application under 35 U.S.C. §371 of International Patent Application No. PCT/JP02/11329 filed Oct. 31, 2002, and claims the benefit of Japanese Patent Application Nos. 2001-340071 filed Nov. 5, 2001; 2001-340072 filed Nov. 5, 2001 and 2002-184580 filed Jun. 25, 2002 which are incorporated by reference herein. The International Application was published in Japanese on May 15, 2003 as WO 03/040448 A1 under PCT Article 21(2).

TECHNICAL FIELD

The present invention relates to stretchable warp-knitted fabric that is thin and has beautiful knitted loops and large stretchability, formed by using a non-elastic yarn and an elastic yarn, a method for manufacturing the fabric, and clothing manufactured by using the fabric. Furthermore, in particular, the clothing of the present invention relates to novel stretchable clothing that has appropriate stretchability, an excellent fashion property, and the like, and is formed particularly with a cut edge intact.

BACKGROUND ART

With the increasing progress in the diversification and tendency toward fashion of clothing, in particular, clothing for women, a variety of knitted fabrics have been invented one after another, and put into practical use, which enriches life. The diversification and tendency toward fashion of clothing for women have progressed more and more with the times. Above all, there is a great demand for fashionable foundation clothing that has appropriate stretchability enabling the clothing to well fit the body of a wearer, that is thin and has beautiful knitted loops, and that, when it is formed in underwear, has a hemline invisible through outerwear. In addition, there is a tendency that a cut edge of knitted fabric is used as it is without hem finishing (hemming) so that the knitted fabric can be used as fashionable clothes.

Among the knitted fabrics, there is a great demand for fashionable knitted fabric that is thin and has beautiful knitted loops, and that has large stretchability enabling the fabric to well fit the body of a wearer. Furthermore, recently, there also is the following tendency: knitted fabric is formed, which is unlikely to be frayed at a cut edge when the fabric is cut, and the knitted fabric is used with a cut part thereof intact without processing an edge to form clothing, whereby a sawing operation is simplified, and such knitted fabric is used for fashionable clothes.

In conventional clothing, in order to prevent a cut edge (edge that is cut in an intact state) from being frayed, it is necessary to perform some finishing (processing). Such hem finishing necessitated by cutting is called hemming or the like, and its method is varied depending upon a portion and a material. For example, a cloth edge is sewn up while being folded back; a cloth edge is sewn up with another cloth or a stretchable tape attached thereto; or a cloth edge is subjected to thread stitching. This operation causes a considerable burden in sewing of clothing. Furthermore, a hemline of underwear is seen in a convex shape through outerwear, which impairs wearing comfort.

Conventionally, for making it unnecessary to finish an edge of clothing, there are methods for pulling out a yarn from spandex power net knitted fabric and for sewing knitted fabric, an end of a lace of which is cut so as to make it difficult for an edge to be frayed, into clothing. However, in any of these methods, an edge of clothing to be provided has a straight line or a substantially straight line, and edges that are not required to be finished can be formed only in upper and lower parallel lines.

If knitted fabric, in which an edge required not to be finished is formed in various shapes such as a straight line, a curve, or a combination thereof at various angles, and which has tightness, solidity, and a straining force as a whole, is used, thereby enabling an edge of knitted fabric required not to be finished to be used as an edge of clothing, clothing also can be formed that does not require hem finishing and has a straining force. Clothing can be formed from a body fabric that is continuous in a vertical direction without any sewn parts in a vertical direction, even though an upper end and a lower end of the fabric are not parallel to each other. Thus, flat clothing with less difference in level having a small number of sewn parts can be enjoyed.

The present invention has been achieved based on the study of simplification of sewing, and provision of new knitted fabric, clothing, and the like.

Conventionally, in the field of a tricot knitting machine, two guide bars are used, and the respective guide bars are moved in opposite directions at all times for each course to supply knitting yarns symmetrically, whereby a stable double tricot that is unlikely to be frayed is used widely. However, the above-mentioned knitted fabric has a disadvantage of poor stretchability. Therefore, in order to satisfy the demand for knitted fabric having large stretchability, stretchable knitted fabric of various kinds of knitted textures has been developed and manufactured. Even in the present invention, improvement of various kinds of knitted textures have been studied so as to solve the above-mentioned problem. As a result, the following was found. A double-tricot texture knitted by using a non-elastic yarn and an elastic yarn may be one potential solving means. However, during sewing, an elastic yarn overlapped with the back face of a non-elastic yarn tends to be cut at parts where knitting yarns cross in an X-shape. Therefore, there is a disadvantage that so-called pinholes may be generated. Furthermore, an elastic yarn is exposed to the surface side, which causes dye irregularity.

On the other hand, a 1×1 tricot texture (which also is called a single tricot or a single denbigh) knitted by using a non-elastic yarn with one guide bar has aligned knitted loops and thin; however, the knitted loops are likely to be frayed and lack stability (loop-drop is likely to occur). Thus, such a 1×1 tricot texture is hardly used for purposes other than a special purpose. However, the inventors of the present invention considered the following: if a non-elastic yarn and an elastic yarn are knitted so as to run side by side based on a 1×1 tricot, the non-elastic yarn and the elastic yarn do not cross each other; consequently, stretchable knitted fabric can be formed, which has a beautiful aligned texture and in which an elastic yarn having poor dye-affinity is positioned at lower loops (back side) of a non-elastic yarn to make it difficult to cause dye irregularity. Furthermore, the inventors of the present invention studied minimization of the fraying of even an intact cut edge by providing the knitted fabric with practicable stability, thereby solving the above-mentioned problem. Thus, the inventors of the present invention accomplished practical stretchable warp-knitted fabric that still keeps a fashionable feature of a 1×1 tricot and is unlikely to be frayed at a cut part, a method for manufacturing the stretchable warp-knitted fabric, and stretchable clothing using the stretchable warp-knitted fabric.

Prior to the description of the present invention, the meaning of main terms to be used in the specification of the present application will be described.

The term "stretchable warp-knitted fabric" refers to stretchable warp-knitted fabric based on a 1×1 tricot texture knitted by running a non-elastic yarn and an elastic yarn side by side.

The term "forming" of clothing refers to forming clothing from cloth such as knitted fabric, including all the seaming operations such as sewing with a sewing machine and seaming with an adhesive or heating.

The term "edge without hemming" refers to an intact cut edge, i.e., an edge of knitted fabric or clothing without hem finishing such as folding, hemstitching, etc., for preventing fraying.

SUMMARY OF INVENTION

Stretchable warp-knitted fabric of the present invention is a 1×1 tricot knitted by running a non-elastic yarn and an elastic yarn side by side, in such a manner that in each stitch, at least one of the non-elastic yarn and the elastic yarn forms a closed loop.

Furthermore, a method for manufacturing stretchable warp-knitted fabric of the present invention includes, in knitting the above-mentioned stretchable warp-knitted fabric, knitting in a drawing yarn, knitting edging yarns to both sides of the drawing yarn, inlaying an elastic yarn to both the edging yarns from a side to which each edging yarn belongs to, allowing a part of the inlaid elastic yarn to be tangled with the drawing yarn, and pulling out the drawing yarn after knitting, thereby dividing the knitted fabric into a plurality of parts.

Furthermore, the stretchable clothing of the present invention is formed so as to include stretchable warp-knitted fabric that is a 1×1 tricot knitted by running a non-elastic yarn and an elastic yarn side by side, in such a manner that in each stitch, at least one of the non-elastic yarn and the elastic yarn forms a closed loop.

DETAILED DESCRIPTION OF THE INVENTION

Figure 1A:
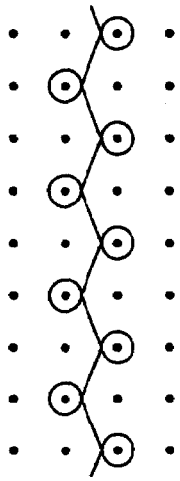
FIGS. 1A to 1D are knitted texture diagrams for illustrating basic knitted textures used for stretchable warp-knitted fabric according to the present invention.

Stretchable warp-knitted fabric of the present invention is a 1×1 tricot knitted by using a non-elastic yarn and an elastic yarn so as to allow them to run side by side in such a manner that in each stitch, at least one of the non-elastic yarn and the elastic yarn forms a closed loop.

Among the stretchable warp-knitted fabrics of the present invention, the following particularly are preferable: knitted fabric in which both a non-elastic yarn and an elastic yarn form closed loops; knitted fabric in which a non-elastic yarn forms closed loops, and an elastic yarn forms open loops; and knitted fabric in which both a non-elastic yarn and an elastic yarn form open loops and closed loops alternately in such a manner that in each stitch, the elastic yarn forms a closed loop with respect to an open loop formed by the non-elastic yarn, and the elastic yarn forms an open loop with respect to a closed loop formed by the non-elastic yarn.

Furthermore, the stretchable warp-knitted fabric of the present invention is formed into cloth with a high density of 60 wales or more per inch. Furthermore, the runner of a non-elastic yarn is set to be larger than that of an elastic yarn. The runner of a non-elastic yarn is set to be 85 to 120 cm/rack, and the runner of an elastic yarn is set to be 70 to 110 cm/rack. Thus, more excellent and stable knitted fabric is obtained. Preferably, the stability of knitted fabric can be enhanced by performing preset and/or heat set at a temperature equal to or higher than 180° C.

Herein, the term "runner" refers to a length (cm) of a yarn used for knitting a predetermined course number (this is called a "rack", and generally, 480 courses are set to be one rack. As the value of a runner is decreased, i.e., as the length of a yarn per rack is shorter, a knitted texture is tighter.

Furthermore, depending upon a use purpose, the following knitted fabrics respectively are useful: the knitted fabric of the present invention in which an elastic yarn having a fineness larger than that of the other parts is used partially for a knitting yarn to form a reinforced fastening part; the knitted fabric of the present invention in which an elastic yarn further is inlaid or the knitted fabric of the present invention in which a non-elastic yarn further is inlaid; and the knitted fabric of the present invention that is knitted or cut into a tape shape.

The above-mentioned stretchable warp-knitted fabric can be patterned by using a Jacquard raschel knitting machine (in a strict sense, the term represents the concept including both a Jacquard single raschel knitting machine and a Jacquard double raschel knitting machine, but in general, is often used for referring to a Jacquard single raschel knitting machine). If the Jacquard double raschel knitting machine is used, knitted fabric can be knitted into a tube shape or a bag shape, and further can be patterned. Thus, a use range is enlarged. Furthermore, depending upon a use purpose, a plurality of the identical knitted fabrics may be laminated to be attached to each other, or a plurality of at least two kinds of knitted fabrics selected from these stretchable warp-knitted fabrics may be combined, and laminated to be attached to each other. Furthermore, a pattern and a shape are added or required openings are provided by, for example, printing, embossing, opal processing, molding, and drilling (e.g., punching) by after-processing to enhance an added value easily, whereby various requests of users can be satisfied.

It is natural that the above-mentioned stretchable warp-knitted fabric can be formed by general knitting means. In knitting, the following also is possible: edging yarns are knitted into both sides of a drawing yarn, an elastic yarn is inlaid to each edging yarn from a side to which each edging yarn belongs, a part of the inlaid elastic yarn is tangled with the drawing yarn, and the drawing yarn is pulled out after knitting, whereby the knitted fabric can be divided into a plurality of parts.

A textile product obtained by sewing the stretchable warp-knitted fabric of the present invention can be used widely. On the other hand, there is a possibility that by manufacturing clothing with a cut edge partially or entirely intact, a new fashionable fiber product can be provided. That is, the stretchable knitted fabric of the present invention is unlikely to be frayed at a cut edge. Therefore, so-called hem finishing such as folding and sewing of an edge is not required. Thus, the stretchable warp-knitted fabric provided with a pattern by using a jacquard raschel knitting machine or knitted into a tube shape or a bag shape by using a jacquard double raschel knitting machine has an enhanced fashion property as clothing, and is very valuable as means for simplifying sewing. Furthermore, the knitted fabric of the present invention knitted or cut into a tape shape is attached or sewn to a required position of a textile product, thereby providing a required fastening power.

The stretchable warp-knitted fabric of the present invention will be described more specifically by way of exemplary embodiments with reference to the drawings, if required. The fineness in the present invention means the total fineness of a yarn.

Figure 1B:
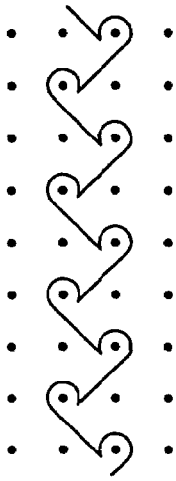
Figure 1C:
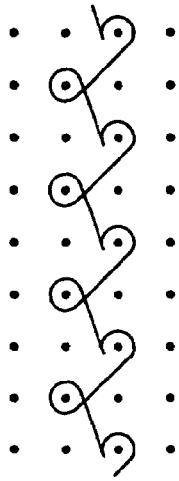
Figure 1D:
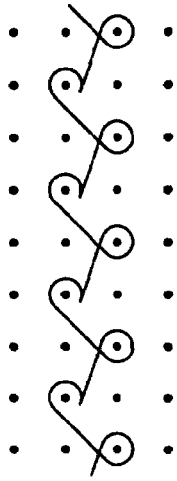

FIGS. 1A to 1D show basic knitted forms of a 1×1 single tricot. The stretchable warp-knitted fabric of the present invention can be knitted mainly by combining the knitted forms shown in FIGS. 1A to 1D, using two guide bars. However, the present invention is not limited thereto. For example, two closed loops and two open loops may be arranged alternately. It should be noted that it is necessary to select such a combination that in each stitch, at least one of a non-elastic yarn and an elastic yarn running side by side as knitting yarns forms a closed loop. FIG. 1A represents the case where all the stitches are closed loops, and FIG. 1B represents the case where all the stitches are open loops. FIGS. 1C and 1D represent the case where closed loops and open loops appear alternately.

First, the stretchable warp-knitted fabric of the present invention is a 1×1 tricot stitch formed by running a non-elastic yarn and an elastic yarn side by side, which has stretchability and a beautiful texture with aligned stitches, and is thin. The 1×1 tricot stitch has a short under-lap (sinker loop length). Particularly, in the present invention, in each stitch, at least one of a non-elastic yarn and an elastic yarn forms a closed loop, thereby stabilizing knitted loops and preventing fraying.

As the non-elastic yarn, synthetic fibers such nylon and polyester, semi-synthetic fibers such as rayon, natural fibers such as silk and cotton, a filament yarn, a spun yarn, and the like can be used. Among them, nylon that has excellent water absorbency preferably is used as knitted fabric for innerwear. There also is no particular limit to an elastic yarn. A polyurethane elastic yarn and a polyether/ester elastic yarn can be used. In general, a polyurethane elastic yarn and its covered elastic yarn (covered yarn) that are used widely are preferable.

Figure 2:
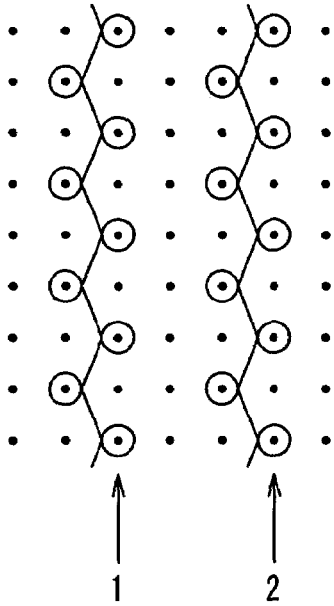
FIG. 2 shows a knitted texture of stretchable warp-knitted fabric of the present invention, in which both a non-elastic yarn and an elastic yarn form closed loops.
Figure 3:
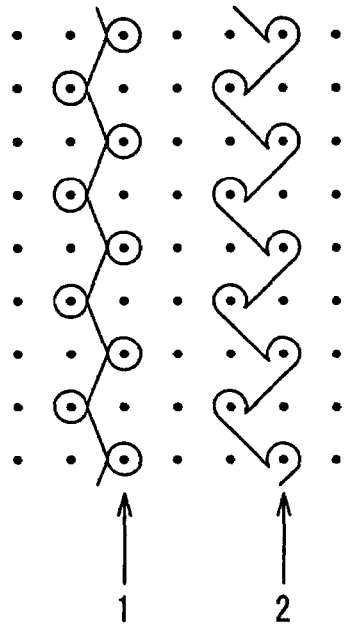
FIG. 3 shows a knitted texture of stretchable warp-knitted fabric of the present invention, in which a non-elastic yarn forms closed loops and an elastic yarn forms open loops.

Among the knitted fabrics of the present invention, stretchable warp-knitted fabric (A) in which both a non-elastic yarn 1 and an elastic yarn 2 form closed loops as shown in FIG. 2; stretchable warp-knitted fabric (B) in which a non-elastic yarn 1 forms closed loops, and an elastic yarn 2 forms open loops as shown in FIG. 3; and stretchable warp-knitted fabric (C) in which both a non-elastic yarn 1 and an elastic yarn 2 form open loops and closed loops alternately in such a manner that in each stitch, the elastic yarn 2 forms a closed loop with respect to an open loop formed by the non-elastic yarn 1, and similarly, the elastic yarn 2 forms an open loop with respect to a closed loop formed by the non-elastic yarn 1 are excellent in a practical sense. The knitted fabrics (A) and (B) particularly are excellent in an outer appearance. The knitted fabric (C) is unlikely to cause loop-drop.

Next, it is desirable that the stretchable warp-knitted fabric of the present invention is knitted with a smallest possible width, i.e., is knitted with a large knitting density, so as to keep beauty of knitted loops and enhance its stability. The fineness of a knitting yarn appropriately is selected depending upon the kind of clothing for which knitted fabric is used and the portion where the knitted fabric is used. In the case where the knitted fabric is used for underwear for women, generally, an elastic yarn preferably has a fineness of 44 to 78 dtex. In the case of using two elastic yarns, the fineness thereof preferably is in a range of 44 to 88 dtex, and the fineness of a non-elastic yarn preferably is in a range of 22 to 44 dtex. For knitting, the knitted fabric may be formed into narrow cloth with a knitting density of 65 wales or more, preferably, about 70 wales per 2.54 cm (1 inch), whereby the ratio of horizontal stretch of the knitted fabric is increased. The upper limit of the knitting density is about 100 wales. Specifically, for example, in the case where knitted fabric is knitted with the total number of knitting yeans of 3600 (herein, one combination of a non-elastic yarn and an elastic yarn that run side by side is counted as one) using a 130-inch Raschel knitting machine, the finished width of usual knitted fabric is set to be about 160 cm. According to the present invention, it is desired that the knitting density is enhanced to finish knitted fabric with a small width of about 130 cm. However, this is not applied in the case where a cellulose yarn and a cotton yarn are knitted as a non-elastic yarn. In the case where the fineness of an elastic yarn is large, in particular, 130 dtex or more, the knitting density may be set to be about 60 wales per inch, the total number of yarns may be set to be 3600, and the finished width may be set to be about 150 cm.

Furthermore, preferably, the amount of a yarn to be used is increased compared with the general amount, whereby the runner of a non-elastic yarn is set to be larger than that of an elastic yarn to obtain imbalance. Specifically, generally, knitted fabric is knitted under the condition that the runner of a non-elastic yarn is set to be 85 to 120 cm/rack, preferably 95 to 115 cm/rack, although it generally is set to be 80 cm/rack or less, and the runner of an elastic yarn is set to be 70 to 110 cm/rack, preferably 75 to 105 cm/rack, although it generally is set to be 60 cm/rack. When the runner of an elastic yarn with respect to the runner of a non-elastic yarn is set to be about 75 to 90%, appropriate stretch can be provided in a transverse direction, which is preferable.

Furthermore, for the purpose of obtaining the stability of knitted fabric and preventing fraying, it is preferable that preset and/or heat set is performed under a condition exceeding a predetermined temperature. This temperature is varied depending upon the shape of an apparatus, a preset processing time, a heat set processing time, the kind of materials, the thickness of knitted fabric, and the like. When preset and/or heat set is performed at a temperature equal to or higher than 180° C., preferably at least 185° C., and in a range of 190° C. to 195° C. for obtaining the above-mentioned effect exactly, a part of the knitted fabric is softened to be lightly fused, whereby the form of the knitted fabric is stabilized, making it more difficult for the knitted fabric to be frayed. In the case where preset and/or heat set is performed at the above temperature, the processing time is set so as to enable knitted fabric to run at a speed of about 15 to 40 m/min. preferably 24 to 36 m/min., for example, using a 6 to 8-chamber apparatus (chamber total length: 15 to 30 m).

In the above-mentioned stretchable warp-knitted fabric of the present invention, an elastic yarn having a fineness larger than that of the other parts is used partially for a knitting yarn, whereby a knitted fabric part with a reinforced fastener can be formed integrally. Such knitted fabric is useful for the purpose of sewing underwear and girdles for women that require a part with a reinforced fastener, which also serves for reducing a sewing cost. Furthermore, an elastic yarn or a non-elastic yarn further is inlaid to the above-mentioned stretchable warp-knitted fabric of the present invention, and the fineness and density of the inlaid yarn are adjusted appropriately, whereby knitted fabric having a desired extension and stretch power can be formed, or the stability of knitted loops can be enhanced. Furthermore, for example, by using appropriate natural fibers on a back surface as an inlay yarn, the touch feeling to the skin can be enhanced. Furthermore, a pattern yarn may be inlaid appropriately so as to provide a fashion property.

In order to provide a pattern, a Jacquard mechanism may be used. The Jacquard raschel knitting machine is less subject to constraints for patterning, and is capable of appropriately providing complicated patterning easily. Furthermore, if the Jacquard double raschel knitting machine is used, knitted fabric can be formed into a tube shape or a bag shape simultaneously. In the case of forming the knitted fabric of the present invention with a pattern, the runner of a pattern yarn is 40 to 120 cm/rack, the total number of yarns is 600 to 3600, and a finished width is in a range of 100 to 130 cm. The knitted fabric of the present invention is prevented from being frayed even under the condition that a cut edge is intact. Therefore, the knitted fabric of the present invention formed into a tube shape or a bag shape and provided with a pattern, if required, can be formed into clothing without sewing merely by cutting. In this case, sewing is simplified, and simultaneously, a seam line is not seen through outerwear. Therefore, the clothing thus obtained is useful for seamless wear.

It is convenient that the stretchable warp-knitted fabric of the present invention is formed or cut into a tape shape. In such knitted fabric, a cut edge is unlikely to be frayed. For example, these tape-shaped knitted fabrics can be sewn or attached with an adhesive to an upper/lower edge of back cloth of a brassier, a waist band of a short panty, a girdle, or the like, thereby providing an appropriate fastening power easily.

In a portion, such as back cloth of a brassier, where a stronger stretch power and tightness are required, a plurality of the same knitted fabrics of the present invention are laminated to be attached to each other, or a plurality of at least two kinds of knitted fabrics selected from these stretchable warp-knitted fabrics can be laminated to be attached to each other. Generally, the same two knitted fabrics are attached to each other with an adhesive placed in a dot shape. However, the present invention is not limited thereto.

The knitted fabric of the present invention can be subjected to various kinds of after-processing, if required, whereby an added value can be enhanced. For example, a required pattern may be provided by, for example, printing, heat embossing, or drilling (e.g., punching). Furthermore, a required shape may be provided by molding so that the resultant knitted fabric is used for a brassier cup. Furthermore, patterned beautiful knitted fabric may be obtained by mixing a third fiber by blending, interknitting, or the like, and performing so-called opal processing in which the third fiber is partially removed to provide a pattern by textile printing or the like using an agent that dissolves or decomposes the third fiber after knitting.

Figure 5:
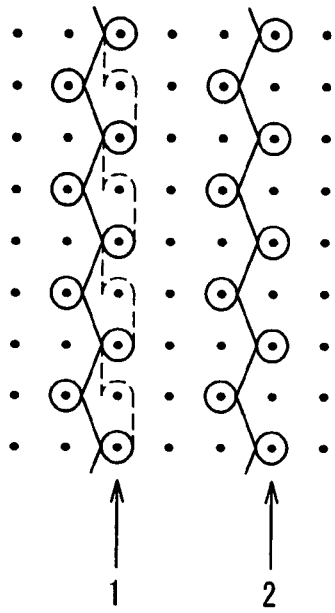
FIG. 5 illustrates how 1×1 tricot knitted fabric is formed by using a double raschel knitting machine with a piezojacquard.

The stretchable warp-knitted fabric of the present invention can be formed with known means by appropriately selecting a raschel knitting machine, a Jacquard raschel knitting machine, a tricot knitting machine, or the like in accordance with a required knitted texture and the like. In addition to conventionally known means, for example, by forming a 1×1 tricot using an elastic yarn 2 for a guide bar for ground knitted fabric as shown in FIG. 5, forming chain stitches represented by a dotted line of a non-elastic yarn in FIG. 5 using a non-elastic yarn 1 for a Jacquard guide bar, and simultaneously, moving the Jacquard guide bar at that operation position by one stitch in a transverse direction on alternate courses (see a solid line of the non-elastic fiber in FIG. 5), using a recently developed single or double raschel knitting machine with a piezojacquard, 1×1 tricot knitted fabric can be formed in which the elastic yarn 2 and the non-elastic yarn 1 run side by side.

In order to efficiently form the knitted fabric of the present invention, a drawing yarn may be knitted in to form the knitted fabric, and thereafter, the knitted fabric may be divided. Specifically, edging yarns are knitted into both sides of a drawing yarn, an elastic yarn is inlaid from a side to which each edging yarn belongs, and a part of the inlaid elastic yarn is tangled with the drawing yarn. After the knitted fabric is formed, the drawing yarn is pulled out, whereby a hem with stable edging yarns can be formed. If a part with a reinforced fastener is formed in the knitted fabric, a drawing yarn is knitted in the part, and the drawing yarn is removed after knitting, the divided knitted fabrics have an integrated power reinforced hem. The hem part of such knitted fabric may be used for an opening end of clothing or the like.

Next, the stretchable clothing of the present invention will be described. The stretchable clothing of the present invention is formed including stretchable warp-knitted fabric having a knitted texture of a 1×1 tricot formed by running a non-elastic yarn and an elastic yarn side by side, in such a manner that in each stitch, at least one of the non-elastic yarn and the elastic yarn forms a closed loop.

It is desirable that, in the course of manufacturing, the above-mentioned stretchable warp-knitted fabric is subjected to preset and/or heat set at a temperature equal to or higher than 180° C.; the stretchable warp-knitted fabric is formed with a density exceeding 65 wales per inch; or the runner of the non-elastic yarn is set to be larger than that of the elastic yarn, the runner of the non-elastic yarn is set to be 85 to 120 cm/rack, and the runner of the elastic yarn is formed at 70 to 110 cm/rack. These knitted fabric forming conditions exhibit the effect of stabilizing a knitted texture even singly or in combination.

As the stretchable clothing of the present invention, stretchable warp-knitted fabric can be used, including a reinforced fastening part in which an elastic yarn having a fineness larger than that of the other parts is used partially as a knitting yarn, or in which an elastic yarn with a large fineness or a plurality of elastic yarns further is inlaid. Furthermore, clothing using stretchable warp-knitted fabric is very useful, which is not frayed even with a part or entire of an edge remaining cut, i.e., an edge without hemming.

Furthermore, the present invention provides stretchable clothing in which stretchable warp-knitted fabric forms at least upper and lower edges of the clothing, and the edges are formed without hemming. Alternatively, the present invention provides stretchable clothing including the stretchable warp-knitted fabric as the same one body fabric that is seamless in the vertical direction, forming the upper and lower edges. Alternatively, the present invention provides stretchable clothing in which lines forming upper and lower edges are not parallel to each other.

In the stretchable clothing of the present invention, it is desirable that stretchable warp-knitted fabric is cut at a portion to be an edge of the closing so that the cutting direction forms an acute angle with the knitting direction of the knitted fabric, thereby forming a body fabric, and the clothing is formed using the cut edge as the edge of the clothing without hemming. More preferably, a cut edge that is cut in a range not exceeding 45° respectively in the right and left of the knitting direction of the stretchable warp-knitted fabric is used as an edge of clothing without hemming.

Furthermore, the stretchable warp-knitted fabric used in the present invention can be effectively used for stretchable clothing, even in a state of laminated stretchable knitted fabric in which a plurality of stretchable warp-knitted fabrics are laminated to be attached to each other. Specifically, the laminated stretchable warp-knitted fabric can be used preferably as back cloth of brassieres or back cloth of clothing for sports corresponding to brassieres.

The stretchable clothing of the present invention will be described specifically by way of exemplary embodiments with reference to the drawings, if required.

The stretchable clothing of the present invention includes the above-mentioned stretchable warp-knitted fabric that is a 1×1 tricot formed by running a non-elastic yarn and an elastic yarn side by side, in such a manner that in each stitch, at least one of the non-elastic yarn and the elastic yarn forms a closed loop. Appropriate stretchability is provided using a non-elastic yarn and an elastic yarn as a knitting yarn. A tricot with a 1×1 knitted texture is beautiful with aligned knitted loops and thin, and has a short under-lap (sinker loop length). In addition, by allowing at least one of the non-elastic yarn and the elastic yarn to form a closed loop in each stitch, a knitted texture is stabilized, and fraying is prevented. As such stretchable knitted fabric, various kinds of the above-mentioned fabrics can be used. Furthermore, in the stretchable clothing of the present invention, in addition to the above-mentioned stretchable knitted fabric, knitted fabric other than those described above, woven fabric, non-woven fabric, leather, or the like can be arbitrarily selected irrespective of the stretchability.

In the stretchable clothing of the present invention, stretchable warp-knitted fabric can be used effectively, in which a reinforced fastening part is integrated by using an elastic yarn having a fineness larger than that of the other parts partially as a knitting yarn, or further inlaying an elastic yarn with a large fineness or a plurality of elastic yarns. The stretchable clothing of the present invention is useful for underwear and girdles for women partially requiring a reinforced fastening part, and also is useful for reducing a sewing cost. Furthermore, the following also may be possible: an elastic yarn or a non-elastic yarn further is inlaid, whereby stretchable warp-knitted fabric with a required extension and stretch power is formed, or stability of knitted loops is enhanced.

In addition to the above-mentioned stretchable clothing of the present invention, stretchable clothing formed by using stretchable warp-knitted fabric with a part or entire of an edge remaining cut (i.e., an edge without hemming) will be described specifically by way of exemplary embodiments. The stretchable clothing including such an edge without hemming utilizes the especially remarkable feature of the stretchable warp-knitted fabric that is unlikely to be frayed at a cut edge, and further is substantially advantageous in functionality, a fashion property, or a cost efficiency.

The shape of an edge of clothing such as a hem which is to be used without hemming in the stretchable clothing of the present invention is not particularly limited, excluding an extreme shape such as extremely pointed serrated edge. Even if any part of the stretchable warp-knitted fabric is cut, fraying does not occur, which makes it unnecessary to finish an edge. Therefore, a curve line, a waveform line, and the like can be adopted freely in accordance with the preference. Furthermore, according to the stretchable clothing of the present invention, stretchable warp-knitted fabric is used for both upper and lower ends of clothing so as to make lines forming the upper and lower edges non-parallel to each other without hemming. Thus, compared with a conventional product requiring finishing of an edge in terms of a function and a design, an edge of clothing such as a waist and a bottom can be designed freely in a wide range. Furthermore, the body fabric forming upper and lower edges is formed using the same one stretchable warp-knitted fabric without seams, whereby seams running in a horizontal direction may be eliminated. More specifically, by using a body fabric without any seams in a vertical direction, or by forming an edge without hemming, clothing becomes flat with less difference in level, enhancing the wearing comfort.

Figure 6:
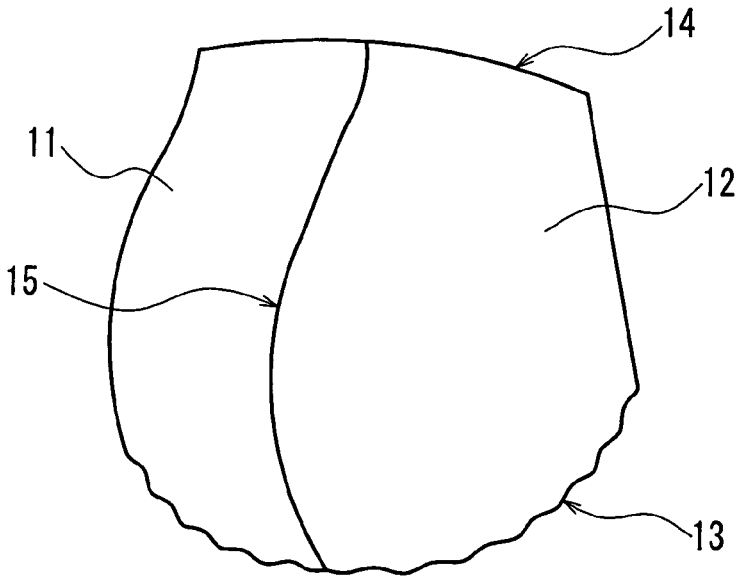
FIG. 6 is a perspective view seen from a back side of a short panty that is an example of stretchable clothing of the present invention.

FIG. 6 shows a short panty that is an exemplary embodiment of the stretchable clothing of the present invention. In the short panty, a hip part is divided into the left and right sections. In each vertical direction, one continuous stretchable warp-knitted fabric is used as hip clothes 11 and 12. A bottom part 13 at the lower end and a waist part 14 at the upper end are formed without hemming, whereby a sewn part in a horizontal direction (transverse direction) is eliminated. Furthermore, a line 13 of an edge of the bottom part is provided with a waveform line that is not a lace and is not frayed even without finishing the edge in spite of the warp-knitted fabric, which used to be impossible conventionally unless an edge is finished. Thus, the line 13 is provided with a fashion property. In this manner, one continuous cloth is used from the waist to the bottom, and the edges of a waist line and a bottom line are not finished, whereby an edge of a body fabric cut from knitted fabric is used as the waist line and the bottom line of the short panty. Reference numeral 15 denotes a center rear seam line between the left and right hip clothes 11 and 12. The short panty has the effect of shaping the wearer's body by providing an appropriate fastening force to the hip. The short panty does not provide an uncomfortable feeling in the bottom part due to the hem finishing, and are popular in terms of a design. Furthermore, a line of underwear is not seen through outerwear. Upper and lower edges that are the waist line and the bottom line of the short panty composed of one body fabric continuous in a vertical direction can have an arbitrary curve while the edges are unlikely to be frayed even without hem finishing.

Figure 7:
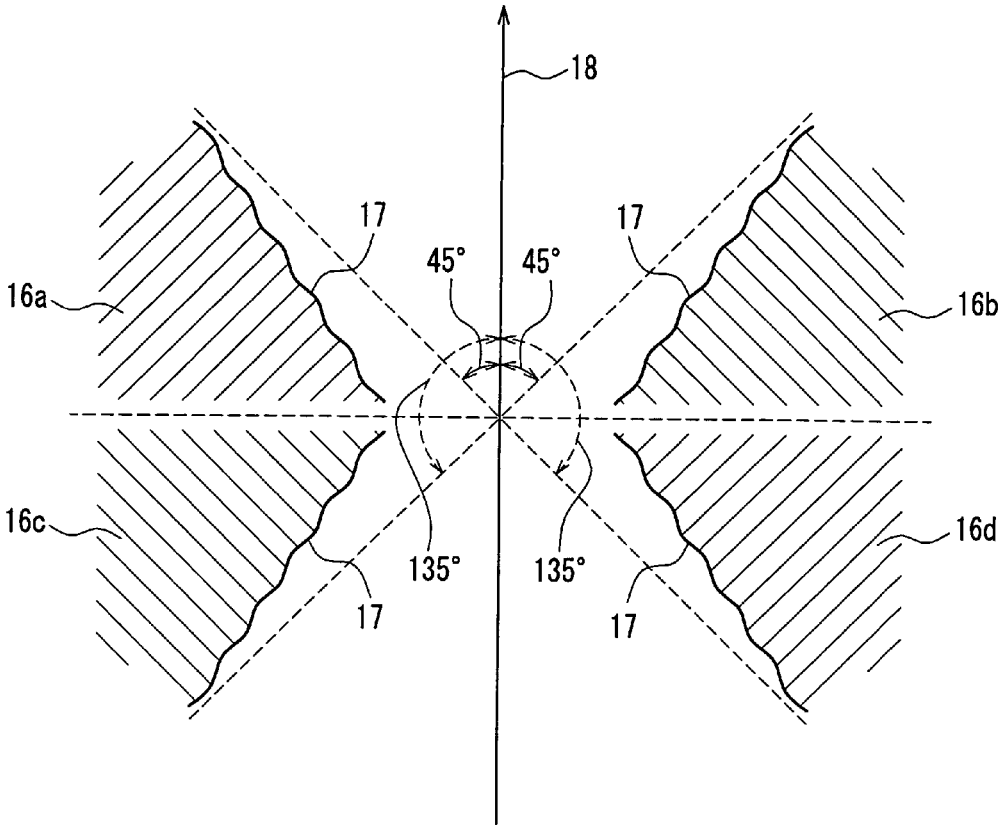
FIG. 7 is a reference diagram showing a relationship between an edge of knitted fabric to be left without hemming and a cutting direction of stretchable warp-knitted fabric.

In the stretchable clothing of the present invention, it is preferable that, in designing an edge of an end part without hemming, a cut edge without hemming is set so as to be cut at an acute angle with respect to the knitting direction of the knitted fabric, for cutting the stretchable warp-knitted fabric. The reason for this is as follows: when the direction of a cutting line of a cut edge is at an acute angle with respect to the knitting direction, compared with the case of an obtuse angle, the cut edge is further unlikely to be frayed. When a body fabric is cut so that an edge without hemming is substantially parallel to the knitting direction the knitted fabric, (i.e., the edge does not form an angle with respect to the knitting direction), the cut edge is most unlikely to be frayed. That is, when the knitted fabric is cut in a range not exceeding 45° in the left and right of the knitting direction of the knitted fabric, the cut edge is further unlikely to be frayed, which is preferable. As the angle of the cutting line with respect to a knitting direction approaches an obtuse angle, for example, 135°, fraying becomes slightly noticeable. Therefore, preferably, care should be taken so that a line forming an angle exceeding 135° with respect to the knitting direction does not become the cutting line to be formed without hemming. FIG. 7 shows a reference diagram showing a relationship between edges 17 of knitted fabric 16 to be formed without hemming and a cutting direction of stretchable warp-knitted fabric for assisting in understanding of this cutting. The direction of an arrow 18 denotes a knitting direction. The edges 17 that are cutting lines of knitted fabrics 16*a* and 16*b* are more unlikely to be frayed, compared with the edges 17 that are cutting lines of knitted fabrics 16*c* and 16*d*.

Figure 8:
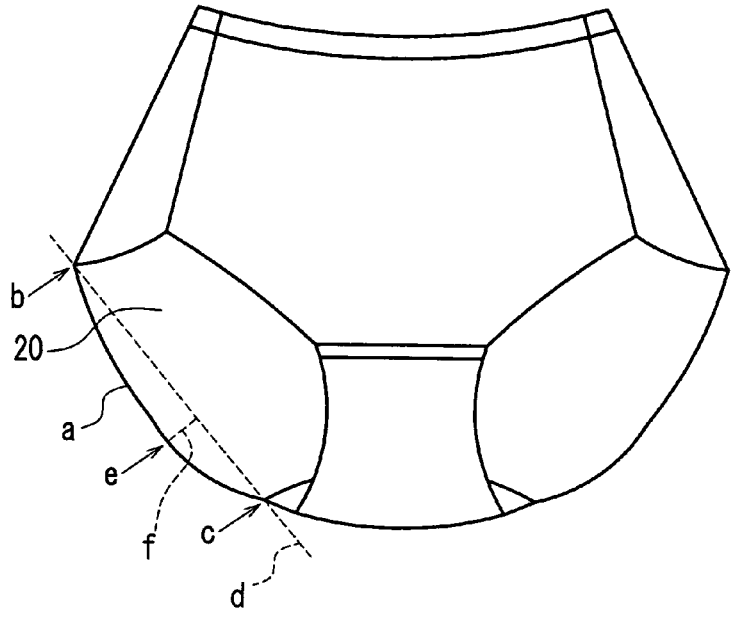
FIG. 8 is an explanatory diagram showing an example of a preferable curve shape of a bottom edge of a short panty that is an example of stretchable clothing of the present invention.

The stretchable knitted fabric can be used for various kinds of clothes, utilizing its advantage. It is preferable that an edge of a body fabric cut in an arbitrary shape that is not required to be subjected to hem finishing is used for a waist part and a bottom edge part of clothing having at least a lower body part, such as a girdle or a short panty, and upper and lower edges of back cloth of a brassier. For example, panties such as a short panty in which a bottom hem part of hip cloth is formed without hemming with a large curve have a simple design and are excellent in wearing comfort. An exemplary shape of a preferable curve "a" of a bottom edge of hip cloth 20 such as a short panty will be described with reference to FIG. 8. Under the condition that a short panty is placed flat with a front surface upward and both sides folded, a line "d" connecting an upper end "b" of a bottom hem part of hip cloth to a lower end "c" of the bottom hem part of the hip cloth is connected to a point "e" of a lower side of the curved hip cloth projecting most with a perpendicular line "f", a curve enabling a length of the perpendicular line "f" to be 15 mm or more, i.e., a curve line substantially following a lower end of the bulge of the hip can be designed. Short bottom clothing that has an edge of the bottom part formed without hemming, and outlines a curve in the above shape is likely to follow a round stereoscopic shape of the hip, and has the excellent effect of enhancing a fitting feeling to the hip without causing difference in level in the bottom hem.

Figure 9:
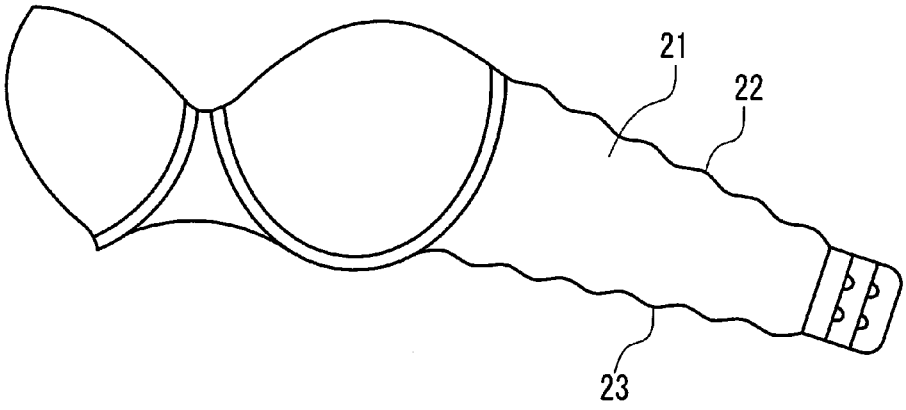
FIG. 9 is a perspective view seen from a front side of a brassiere that is an example of stretchable clothing of the present invention.

Some clothes have a portion that requires a particularly strong stretch power or tightness. In such a portion requiring a stronger stretch power or tightness, a plurality of the same stretchable warp-knitted fabrics are laminated to be attached to each other, or sewn to be laminated. Generally, two of the same knitted fabrics without hemming are attached to each other with an adhesive placed in a dot shape. For example, these laminated fabrics may be used for back cloth 21 of a brassier, a swimming suite, and the like as shown in FIG. 9. One sheet of cloth does not provide sufficient strength. Therefore, a vertical width is not kept during wearing, and back cloth may be rumpled. Such a problem can be solved by providing strength and tightness, using the above-mentioned laminated stretchable warp-knitted fabric. By laminating a plurality of knitted fabrics so that their knitting directions are matched, strength and tightness can be enhanced with stretchability kept. Furthermore, lines of the upper and lower edges 22 and 23 of the back cloth 21 can be cut into an arbitrary shape such as a waveform line and can be used without finishing, as shown in FIG. 9.

Furthermore, in the clothing of the present invention, appropriate patterned holes also may be formed as in lace fabric. In general knitted fabric, when holes are made by after-processing such as punching and cutting after forming knitted fabric, fraying occurs from the holes. However, in a part using the stretchable warp-knitted fabric of the present invention, even if holes are formed by after-processing, for example, punching, cutting, and the like, fraying is unlikely to occur. Therefore, after holes are formed, fraying preventing processing such as stitching so as not to allow the edges of the holes to be frayed is not required. In this respect, a production efficiency is satisfactory. Furthermore, by forming holes appropriately in a patterned shape, clothing with a high added value having an excellent fashion property also can be obtained.

Figure 10:
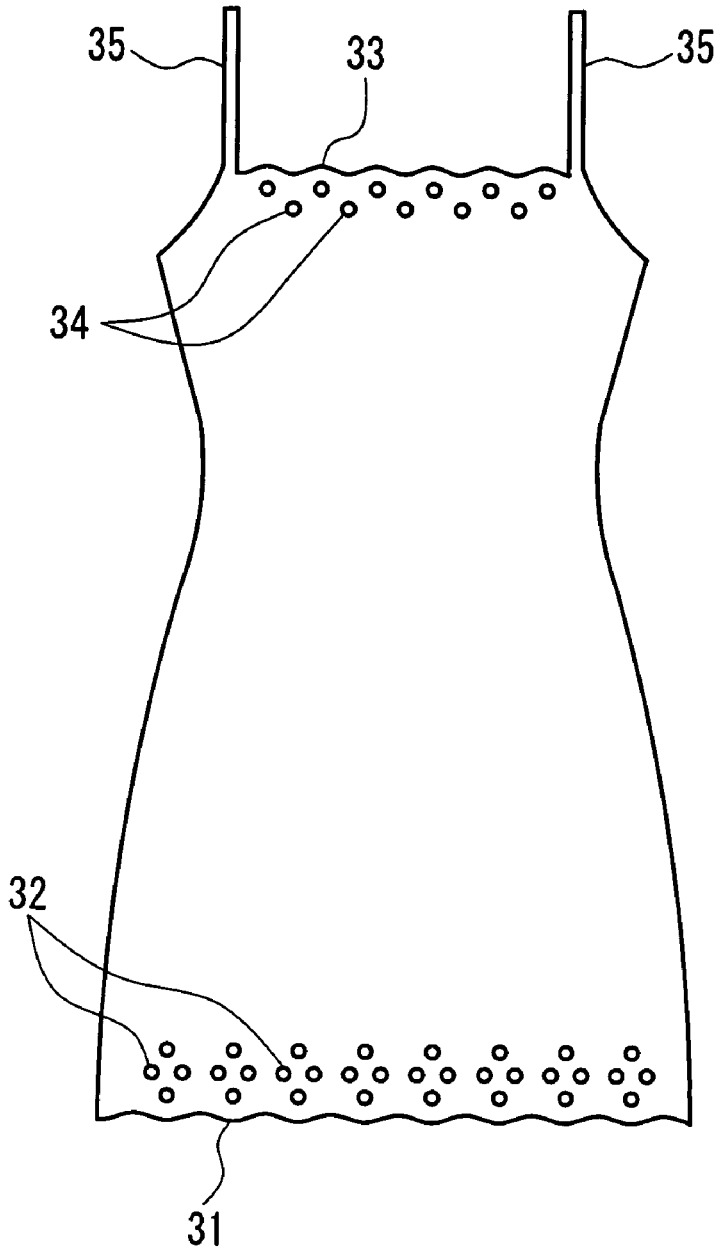
FIG. 10 is a front view of a slip that is an example of stretchable clothing of the present invention.

FIG. 10 is a front view of a slip that is an example of clothing of the present invention using stretchable warp-knitted fabric 36 of the present invention. Reference numeral 35 denotes a shoulder strap. An edge 31 of a bottom hem part has a cutting line in a waveform, and remains cut without hemming. In the vicinity of the edge 31, a plurality of holes 32 are provided by punching, thereby enhancing a fashion property. Similarly, an edge 33 on an upper side of the breast on the front side has a cutting line in a waveform, and remains cut without hemming. In the vicinity of the edge 33, a plurality of holes 34 are provided by punching, whereby a fashion property is enhanced. Thus, even if the holes 33 and 34 are formed by after-processing, fraying is unlikely to occur. Accordingly, a production efficiency is satisfactory, and clothing with a high added value, excellent in a fashion property can be obtained.

As described above, or by using other means, the stretchable clothing of the present invention can use stretchable warp-knitted fabric with an added value enhanced by performing various kinds of after-processings, if required. For example, a required pattern is provided by subjecting stretchable warp-knitted fabric to heat embossing, drilling (e.g., punching), or the like. Furthermore, a required shaping can be performed by molding so that the stretchable clothing can be used for a brassier cup, etc. Furthermore, stretchable clothing can be formed by using beautiful stretchable warp-knitted fabric obtained by mixing a third fiber by means such as blending or interknitting, and performing so-called opal processing in which the third fiber is partially removed to provide a pattern by textile printing or the like using an agent that dissolves or decomposes the third fiber after knitting.

Hereinafter, regarding the knitted fabric of the present invention, the present invention will be described specifically by way of examples for ease of understanding of specific embodiments. The present invention is not limited to the disclosure in the examples.

EXAMPLE 1

A 1×1 tricot was knitted by using a micro full-dull nylon yarn with a fineness of 44 dtex/34 filaments as a non-elastic yarn and a polyurethane transparent yarn (bright yarn) having a fineness of 44 dtex as an elastic yarn with two guide bars and allowing them to run side by side, in such a manner that both the yarns formed closed loops as shown in FIG. 2, by using a raschel knitting machine for a knitting width of 130 inches (330.2 cm). The total number of yarns was set to be 3600, so that a finished width of knitted fabric was set to be 130 cm (about 70 wales/inch) in the present example, although the finished width of the knitted fabric usually was supposed to be about 160 cm, whereby a knitted texture with a high density was obtained with a smallest possible width. Furthermore, the runner of the nylon yarn was set to be 100 cm/rack in the present example, although it was supposed to be set at 80 cm/rack or less in typical knitted fabric. The runner of the polyurethane yarn was set to be 80 cm/rack, although it was supposed to be 60 cm/rack or less in typical knitted fabric. After knitting, heat set was performed at a heating temperature of 192° C. and 20 m/min. (which was slightly long) by using a 6-chamber apparatus (total length of the chambers: 18 m). The outer appearance of the resultant knitted fabric was well arranged and very attractive.

EXAMPLE 2

A 1×1 tricot was knitted by using the same nylon yarn as that used in Example 1 as a non-elastic yarn and a polyurethane transparent yarn with a fineness of 78 dtex as an elastic yarn with two guide bars and allowing them to run side by side, in such a manner that a non-elastic yarn 1 formed closed loops and an elastic yarn 2 formed open loops as shown in FIG. 3, by using the same knitting machine as that used in Example 1, and finished with the same narrow width as that in Example 1. Furthermore, the runner of the nylon yarn was set to be 110 cm/rack in the present example, although it was supposed to be set at 80 cm/rack or less in ordinary knitted fabric. The runner of the polyurethane yarn was set to be 100 cm/rack, although it was supposed to be set at 80 cm/rack or less in ordinary knitted fabric. The knitted fabric thus formed was subjected to heat set in the same way as in Example 1. The outer appearance of the resultant knitted fabric was well arranged and very attractive.

EXAMPLE 3

Figure 4:
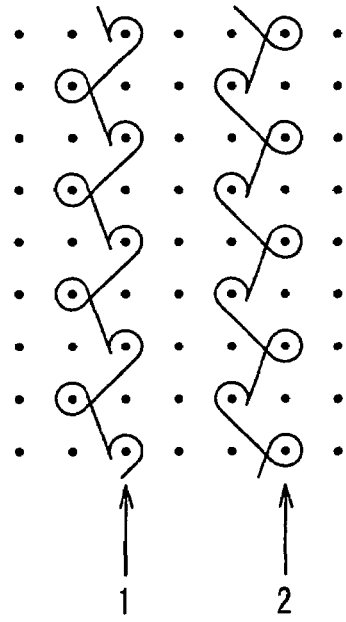
FIG. 4 shows a knitted texture of stretchable warp-knitted fabric of the present invention, in which a non-elastic yarn and an elastic yarn respectively form open loops and closed loops alternately, and in the same stitch, either the non-elastic yarn or the elastic yarn forms a closed loop.

A 1×1 tricot was knitted by using a nylon yarn of 33 dtex as a non-elastic yarn and a polyurethane transparent yarn with a fineness of 44 dtex as an elastic yarn with two guide bars and allowing them to run side by side, in such a manner each yarn formed open loops and closed loops alternately, and in each stitch, an elastic yarn 2 formed a closed loop with respect to an open loop formed by a non-elastic yarn 1, and similarly, the elastic yarn 2 formed an open loop with respect to a closed loop formed by the non-elastic yarn 1 as shown in FIG. 4, by using the same knitting machine as used in Example 1, and finished with a narrow width of 130 cm. Furthermore, the runner of the nylon yarn was set to be 110 cm/rack, although it was supposed to be set at 80 cm/rack or less in ordinary knitted fabric. The runner of the polyurethane yarn was set to be 95 cm/rack, although it was supposed to be set at 60 cm/rack or less in ordinary knitted fabric. The knitted fabric thus formed was subjected to heat set in the same way as in Example 1. The outer appearance of the resultant knitted fabric was slightly poor compared with those of Examples 1 and 2. However, the resultant knitted fabric was unlikely to cause loop-drop, and its tear strength was more excellent than those of the knitted fabrics of Examples 1 and 2.

EXAMPLE 4

Using a Jacquard single raschel knitting machine ("RSJ4/1" produced by Japan Mayer Ltd.) for a knitting width of 130 inches (330.2 cm) including four full set guide bars for ground knitted fabric (one of them is a Jacquard guide bar), 1×1 tricot knitted fabric was formed by using a nylon 66 transparent yarn with a fineness of 33 dtex/26 filaments for the second guide bar and a polyurethane transparent yarn with a fineness of 44 dtex as an elastic yarn for the third guide bar, and allowing them to run side by side, in such a manner that both the yarns formed closed loops as shown in FIG. 2. Furthermore, the knitted fabric was patterned with a Jacquard pattern, using a nylon 66 processing yarn with a fineness of 33 dtex/26 filaments for the first guide bar. The total number of yarns was set to be 3600, and the knitted fabric was finished with a narrow width of about 120 cm. The runner of the nylon 66 yarn of the second guide bar was set to be 107 cm/rack, and the runner of the polyurethane yarn was set to be 90 cm/rack. The runner of the nylon 66 yarn for patterning of the first guide bar was set to be 60 cm/rack. (The fourth guide bar was for an inlay yarn, so that it was not used in the present example). After knitting, heat set was performed at a heating temperature of 192° C. and 20 m/min. using an apparatus with a 6-chamer apparatus (total length of chambers: 18 m). The patterned knitted fabric thus obtained had a good feeling, with a three-dimensional flower pattern appearing on satin-finished ground fabric. A Jacquard pattern may be used for a part with a strong straining force of a band-shaped curve with a large required width to provide the difference in magnitude to the straining force of the knitted fabric so as to cover a required portion of clothing, thereby providing a functionality. For example, by covering a lower part of the bulge of the hip to the waist with a Jacquard part curved in a band shape with a large required width, a girdle and a short panty having a function of keeping the bulge of the hip in a high position can be obtained. By cutting the knitted fabric of the present invention, a girdle was finished without sewing a waist edge part and a bottom edge part. A try-on test was performed, and consequently, the girdle was accepted satisfactorily by the wearer. Furthermore, although the waist edge part and the crotch edge part remained cut, fraying did not occur.

EXAMPLE 5

Knitting was performed and a Jacquard pattern was obtained in the same way as in Example 4, except that using a Jacquard double raschel knitting machine ("RPDJ6/2N" produced by Japan Mayer Ltd.) for a knitting width of 130 inches (330.2 cm) including four full set ground knitted fabric guide bars (two of them are Jacquard guide bars), knitted fabric was formed into a bag shape. As a result, bag-shaped patterned knitted fabric was obtained, in which irregular thick wave patterns were combined in mesh ground fabric. The knitted fabric was cut partially to finish tights without sewing a waist edge part and an ankle edge part. A try-on test was performed, and the tights were accepted satisfactorily by the wearer. Although the waist edge part and the ankle edge part remained cut, fraying did not occur. By appropriately applying this method, a girdle and shorts can be produced similarly.

INDUSTRIAL APPLICABILITY

The stretchable warp-knitted fabric of the present invention is excellent in stretchability as using both a non-elastic yarn and an elastic yarn for a knitting yarn, and basically is a 1×1 tricot stitch having a beautiful knitted texture. Furthermore, the stretchable warp-knitted fabric has a short under-lap (sinker loop length). Therefore, there is an advantage that fraying is unlikely to occur at an edge, and the knitted fabric can be sewn to clothing with the cut fabric intact. Furthermore, by performing knitting by setting the width to be small and increasing the yarn amount to adjust the runner, the stability of the knitted fabric is enhanced, preventing loop-drop. By setting the temperature of dyeing processing and adjusting the processing time to be longer so as to promote softening and fusion of a knitting yarn, the stability of the knitted fabric further is enhanced. Furthermore, if a Jacquard double raschel knitting machine is used, bag-shaped knitted fabric can be formed easily. Therefore, the fabric can be processed to a clothing product that has a cut edge intact and is patterned if required.

Furthermore, the stretchable clothing of the present invention has the effect of shaping the body by providing an appropriate fastening force to a wearer. Furthermore, the stretchable clothing has no uncomfortable feeling due to hem finishing, and is attractive in terms of a design. Furthermore, fraying does not occur even without hem finishing. Therefore, sewing is simplified, which is economical. Furthermore, in the case of using the stretchable clothing for underwear, its line will not affect outerwear. In addition, a line of a clothing edge such as a bottom hem can be formed into a continuously smooth arbitrary curve. The stretchable clothing of the present invention is useful, for example, as underwear such as a girdle, a short panty, a body suit, a brassier, and a shirt; lingerie; and sportswear such as a leotard, spats, and a swimming suit. Needless to say, the present invention also is useful as stretchable clothing for men.

What is claimed is:

1. Stretchable clothing formed so as to include stretchable warp-knitted fabric having a knitted texture that is a 1×1 tricot knitted comprising a non-elastic yarn and an elastic yarn running side by side, in such a manner that in each stitch, at least one of the non-elastic yarn and the elastic yarn forms a closed loop, wherein one of a part and an entire edge of the clothing is formed of a cut edge of the stretchable warp-knitted fabric without hemming; and a line of the edge without hemming has a waveform.

2. The stretchable clothing according to claim 1, wherein the stretchable warp-knitted fabric is subjected to at least one of preset and heat set at a temperature equal to or greater than 180° C.

3. The stretchable clothing according to claim 1, wherein the stretchable warp-knitted fabric is knitted with a density greater than 65 wales per inch (2.54 cm).

4. The stretchable clothing according to claim 1, wherein the stretchable warp-knitted fabric is knitted by setting a runner of the non-elastic yarn to be larger than that of the elastic yarn, and setting the runner of the non-elastic yarn to be 85 to 120 cm/rack and the runner of the elastic yarn to be 70 to 110 cm/rack.

5. The stretchable clothing according to claim 1, wherein the stretchable warp-knitted fabric further comprises a reinforced fastening part by using an elastic yarn having a fineness larger than that of the other parts partially for a knitting yarn, or by inlaying a plurality of elastic yarns.

6. The stretchable clothing according to claim 1, wherein the stretchable warp-knitted fabric forms at least upper and lower edges of the clothing, and the edges remain cut without hemming.

7. The stretchable clothing according to claim 6, which is formed so as to include the stretchable warp-knitted fabric as the same one body fabric without seams in a vertical direction forming the upper and lower edges.

8. The stretchable clothing according to claim 6, wherein lines forming the upper and lower edges without hemming are not parallel to each other.

9. The stretchable clothing according to claim 1, wherein a cutting direction of the stretchable warp-knitted fabric forms an acute angle with respect to a knitting direction, and the clothing is formed so as to include the cut edge without hemming.

10. The stretchable clothing according to claim 1, wherein the stretchable warp-knitted fabric is cut in a range equal to or less than 45° with respect to a knitting direction, and the clothing is formed so as to include the cut edge without hemming.

11. The stretchable clothing according to claim 1, which is one foundation clothing selected from a girdle, a short panty, and a body suite, worn with at least a lower body part included.

12. Stretchable clothing formed so as to include stretchable warp-knitted fabric having a knitted texture that is a 1×1 tricot knitted comprising a non-elastic yarn and an elastic yarn running side by side, in such a manner that in each stitch, at least one of the non-elastic yarn and the elastic yarn forms a closed loop;

the clothing is a foundation clothing selected from one of a girdle, a short panty, and a body suit, wearable with at least a lower body part included; and wherein a bottom hem part on a hip forms one large curve without hemming.

13. The stretchable clothing according to claim 12, wherein the one large curve is shaped in such a manner that when a straight line connecting an upper end of a bottom part of a hip cloth to a lower end of the bottom part of the hip cloth is connected to a most projecting point of a lower side of the cloth abutting on a curved hip with a perpendicular line under a condition that the clothing is placed flat with a front surface upward and right and left sides folded, a length of the perpendicular line is at least 15 mm.

14. The stretchable clothing according to claim 1, which is made of laminated stretchable warp-knitted fabric wherein a plurality of the same stretchable warp-knitted fabrics are laminated to be attached to each other, the stretchable warp-knitted fabric being a 1×1 tricot having a knitted texture including a non-elastic yarn and an elastic yarn running side by side, in such a manner that in each stitch, at least one of the non-elastic yarn and the elastic yarn forms a closed loop.

15. The stretchable clothing according to claim 14, wherein the laminated stretchable knitted fabric is used as back cloth of at least one of brassieres and clothing for sports corresponding to the brassieres.

16. The stretchable clothing according to claim 1, wherein both of the non-elastic yarn and the elastic yarn form closed loops.

17. The stretchable clothing according to claim 1, wherein the non-elastic yarn forms closed loops, and the elastic yarn forms open loops.

18. The stretchable clothing according to claim 1, wherein the non-elastic yarn and the elastic yarn form open loops and closed loops alternatively, in such a manner that in one stitch, the elastic yarn forms a closed loop with respect to an open loop formed by the non-elastic yarn, and in another stitch, the elastic yarn forms an open loop with respect to a closed loop formed by the non-elastic yarn.

* * * * *